US006554922B2

(12) United States Patent
Loeser

(10) Patent No.: US 6,554,922 B2
(45) Date of Patent: Apr. 29, 2003

(54) METHOD AND APPARATUS FOR DETERMINING THE COOLING ACTION OF A FLOWING GAS ATMOSPHERE ON WORKPIECES

(75) Inventor: Kalus Loeser, Mainhausen (DE)

(73) Assignee: Ald Vacuum Technologies AG, Hanau (DE)

( * ) Notice: Subject to any disclaimer, the term of this patent is extended or adjusted under 35 U.S.C. 154(b) by 38 days.

(21) Appl. No.: 09/871,158

(22) Filed: May 31, 2001

(65) Prior Publication Data

US 2002/0036075 A1 Mar. 28, 2002

(30) Foreign Application Priority Data

Jun. 19, 2000 (DE) ..... 100 30 046

(51) Int. Cl.[7] ..... C21D 1/54
(52) U.S. Cl. ..... 148/511; 266/99; 374/43
(58) Field of Search ..... 266/78, 99; 148/511, 148/508, 509; 374/43

(56) References Cited

U.S. PATENT DOCUMENTS 4,412,752 A * 11/1983 Cellitti et al. ..... 374/43
6,257,004 B1 * 7/2001 Gendron et al. ..... 374/43

FOREIGN PATENT DOCUMENTS

| | | |
|---|---|---|
| DE | 3037638 A1 | 5/1982 |
| EP | 0313888 B1 | 5/1989 |
| JP | 459921 A | 2/1992 |

OTHER PUBLICATIONS

Patent Abstracts of Japan, vol. 16, No. 261, Jun. 12, 1992.

* cited by examiner

*Primary Examiner*—Scott Kastler
(74) *Attorney, Agent, or Firm*—Fulbright & Jaworski L.L.P.

(57) ABSTRACT

Method and apparatus for determining the cooling action of a flowing gas atmosphere on workpieces by a measuring body with at least on temperature sensor and heated to workpiece temperature and is exposed to the gas atmosphere. The method and apparatus are particularly useful in hardening steel.

18 Claims, 3 Drawing Sheets

Figure 1:
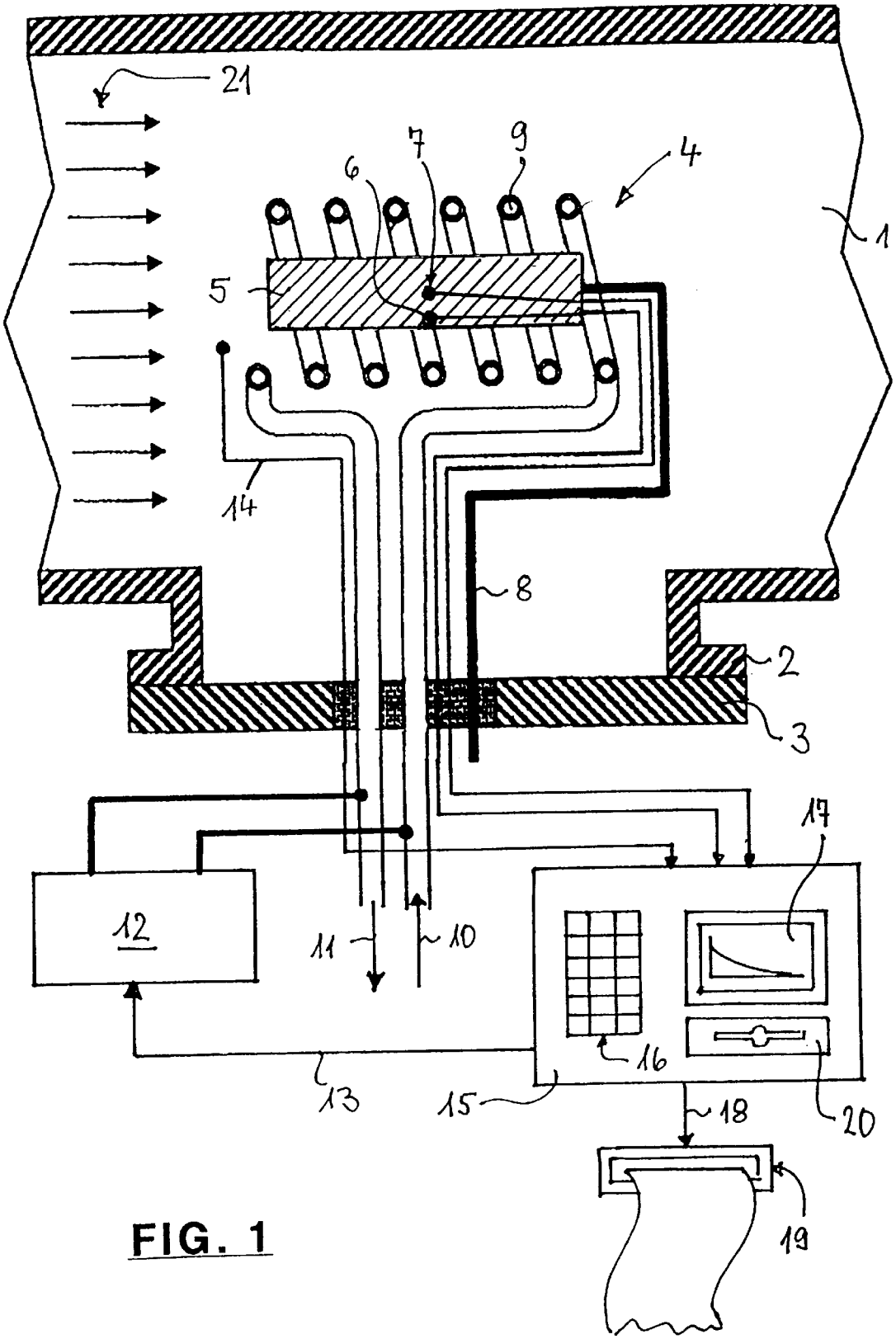

METHOD AND APPARATUS FOR DETERMINING THE COOLING ACTION OF A FLOWING GAS ATMOSPHERE ON WORKPIECES

The invention relates to a method for determining the cooling action of a flowing gas atmosphere on workpieces, especially in the hardening of workpieces of steel, by a measuring body which is provided with at least one temperature sensor and heated to workpiece temperature and is exposed to the gas atmosphere.

It is known through the "Enzyklopädie Naturwissenschaften und Technik," 1981, Zweiburgen Verlag Weinham, Vol. E–J, key word "Hitzdraht" on page 1851, to determine the velocities of gases by blowing them against an electrically heated resistance with a temperature-related characteristic. This heated resistance has a length of about 1 nm and a thickness of a few $\mu$m and virtually no time lag. In the event of a lowering of temperature by cooling, the original temperature and the original resistance are restored by increasing the current by means of a complex control system. For the determination of quenching curves of workpieces in metallurgical processes such an extremely delicate hot wire anemometer is neither foreseen nor suitable.

For this purpose, the workpieces or workpiece batches are quenched to harden them in a quenching chamber within a given time to temperatures below the perlite, bainite and/or martensite temperatures depending on the particular workpiece. The quenching chamber is designed for pressures up to 50 bar and in some cases higher, and hydrogen, helium, nitrogen or mixtures of at least two of these gases are used preferentially as quenching gases. These gases are fed through the batch(s) and removed again by a circulation blower not represented. On their way the quenching gases are passed through a heat exchanger, not shown, and recooled.

The driving power required for the gas circulation increases with pressure but decreases with the atomic weight of the quenching gases, so that hydrogen and helium gases or mixtures thereof are to be given preference, inasmuch as also the transfer of heat to these gases is especially good and the quenching rate is increased. In this case the transfer of heat to the workpieces but also to the heat exchangers is important.

EP 0 313 888 B2 describes first heating workpieces of steel, especially low-alloy steels that are difficult to harden, and/or workpieces of large or complex shape, and then quenching and hardening them with gases from the group, helium, hydrogen and nitrogen, and by gaseous mixtures of at least two gases of this group, at pressures between 10 and 40 bar. This is intended to eliminate the classical hardening methods using water, oils and salt baths with their adverse effect on the environment. The hardening is performed by means of these gases, which are circulated by means of a blower at a high velocity within the apparatus through a heat exchanger and the workpieces or batches of workpieces. The hardening can be performed in a heated single-chamber furnace or in an attached special quenching chamber belonging to the furnace. In the said disclosure the background for the elimination of the known hardening methods is also given.

In such quenching methods the procedure has formerly been to provide parts of a stationary batch with thermocouples. When this was not possible, so-called passive alpha probes have been added to the batch, i.e., special probes provided with thermocouples without a heating device, which are heated by thermal transfer from the adjacent workpieces. The quenching of the workpieces or components was determined by the measurements obtained (offprint "Ipsen Report" of the Ipsen company, article by B. Edenhofer, "Steuerung der Hochdruckgasabschreckung mittels Wärmestromsensor" [control of high-pressure gas quenching by means of a heat flow sensor] of October 1995). In this case measurements of previously run batches are used as a guide for fresh batches.

Such methods of measurement, however, are not possible in the case of moving batches in continuously operating apparatus with so-called "cold chambers," since the batches are passed through individual chambers of the apparatus and the individual chambers are separated from one another by pressure-tight slides. Therefore, in such apparatus the control of the quenching action is performed by monitoring "secondary factors" such as gas pressure, gas temperature, cooling water temperature, as well as the power input of the blower motors for circulating the gas. The determination of the quenching rate from these factors, however, is possible only with a great deal of mathematic calculation, and even then it is highly inaccurate due to measurement tolerances. Such indirect measurements and calculations therefore do not satisfy quality assurance requirements in modem manufacturing processes.

The invention is therefore addressed to the problem of providing a method and an apparatus by which the cooling action and quenching effect, and the time and temperature factors can be determined continuously and directly even in the case of large batches, so that possible adjustments can be performed extremely fast, i.e., in fractions of a second. This is to bring it about that the cooling or quenching, and hardening if desired, of all workpieces of a batch can be performed very quickly according to their hardening specifications.

Particularly the heat transfer from the workpieces or batch of workpieces to the cooling gas is to be controlled in order to prevent harmful heat tensions and/or irregular product quality, and furthermore transfer from the cooling gas to the heat exchanger is to be controlled, because the processes occurring at the workpiece surfaces and at the surfaces of the heat exchanger have an effect on one another.

The solution of the stated problem is accomplished in the method cited in the beginning by the fact that the measuring body is disposed outside of the workpieces and heated by a heating device associated with it to a given starting temperature and is then exposed to the flowing gas atmosphere, and that the cooling time curves measured on the measuring body are measured.

The stated problem is solved to the full extent by the solution according to the invention, and especially the cooling action or quench effect and the temperature time curve are continuously and directly determined, even in large batches, so that any necessary adjustments can be performed extremely fast, i.e., in fractions of a second. Thus it is accomplished that all workpieces of a batch are cooled or quenched and in some cases hardened, with great speed, in a measured manner according to their hardening specifications.

At the same time, it is especially the thermal transfer from the workpieces or batch of workpieces to the cooling gas that becomes controllable, and any harmful distortions due to thermal tensions and/or irregular production properties are avoided, and furthermore, also the thermal transfer from the cooling gas to the heat exchangers can be controlled, because the processes at the workpiece surfaces and at the surfaces of the heat exchanger again influence one another. What is involved is to some extent a synergistic effect. The more difficult the workpieces are to harden, for example in the case of low-alloy pieces and hard-to-harden workpieces and workpieces of large dimensions and complex shapes, different wall thicknesses, etc., the more important the employment of the invention becomes.

Pursuant to additional embodiments of the invention it is especially advantageous if-either singly or in combination:

the cooling time curves are compared with set patterns and if the differences between the actual values and the set patterns are used to control at least one factor from the group: gas pressure, gas velocity and cooling performance of a heat exchanger, if the workpieces are preheated in a heating chamber, the measuring body is heated to the given initial temperature before the workpieces are brought into a quenching chamber equipped with the measuring body, and if after the workpieces are brought into the quenching chamber the heating of the measuring body is interrupted and the measuring body is exposed to the gas atmosphere circulating in the quenching chamber, the temperature of the gas atmosphere is measured with an additional heat sensing device independent of the measuring body and the thermal transfer coefficient is determined in consideration of the measurements made by the heat sensing device of the measuring body, the heating of the measuring body is performed by an induction coil surrounding the measuring body and/or by a heating device (e.g., a heating cartridge) disposed in the measuring body as a heating device, and/or by the fact that the measuring body is heated by passing a current directly through it, the temperature curve through a temperature sensor disposed in the surface area of the measuring body is determined, and/or if the temperature curve is determined by a temperature sensor arranged in the center of the measuring body.

The invention also relates to an apparatus for determining the cooling action of a flowing gas atmosphere on workpieces, especially in the hardening of workpieces of steel, by means of a measuring body provided with at least one temperature sensor and heated to workpiece temperature, which is exposed to the gas atmosphere.

For the solution of the same problem, such an apparatus is constructed according to the invention so that with the measuring body disposed outside of the workpieces there is associated its own heating device with a current source by which the measuring body can be heated to a given initial temperature.

In further embodiments of the apparatus of the invention, it is especially advantageous if either individually or in combination:

the heating device associated with the measuring body is an induction coil surrounding the measuring body, a heating device arranged in the measuring body, or the measuring body itself, to which for this purpose a low-voltage current source is applied in the circuit, to detect the temperature of the gas atmosphere an additional temperature sensor independent of the measuring body is provided by which the heat transfer coefficient can be determined allowing for the measurements made by the temperature sensor of the measuring body, the temperature sensor of the measuring body is switched to a central unit with storage areas, in which the time curves of the measurements made by the temperature sensors can be compared with established and stored set curves, the electric power source of the heating device can be shut off by a central unit after reaching the measuring body's starting temperature which can be preset in the central unit, the central unit is connected through a control line to a medium frequency generator to supply the induction coil, and the induction coil, when the measuring body reaches the starting temperature established in the central unit, can be shut off by the central unit, the measuring body is adapted, in regard to at least one of the factors: material, mass, geometry and emissivity, to the corresponding factors of the workpieces, the measuring body is in the form of cylinder, and/or, if the measuring body (5) is formed from an austenitic alloy with a low emission coefficient.

The invention also relates to the application of the method according to claim 1 and the apparatus according to claim 10 to the high-pressure gas quenching of workpieces in a quenching chamber with a heat exchanger at gas pressures between 5 and 50 bar, preferably between 10 and 40 bar.

Figure 2:
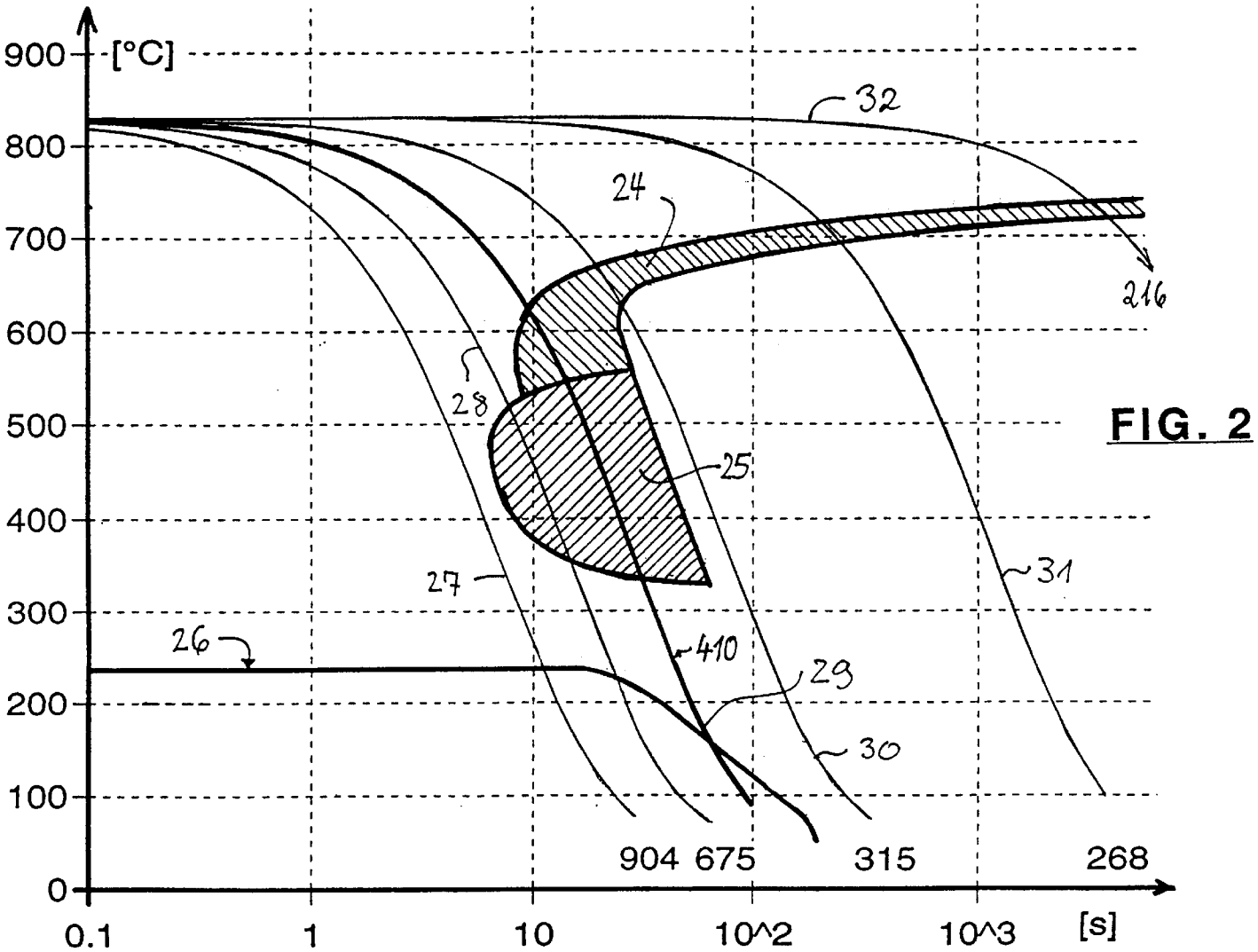
Figure 3:
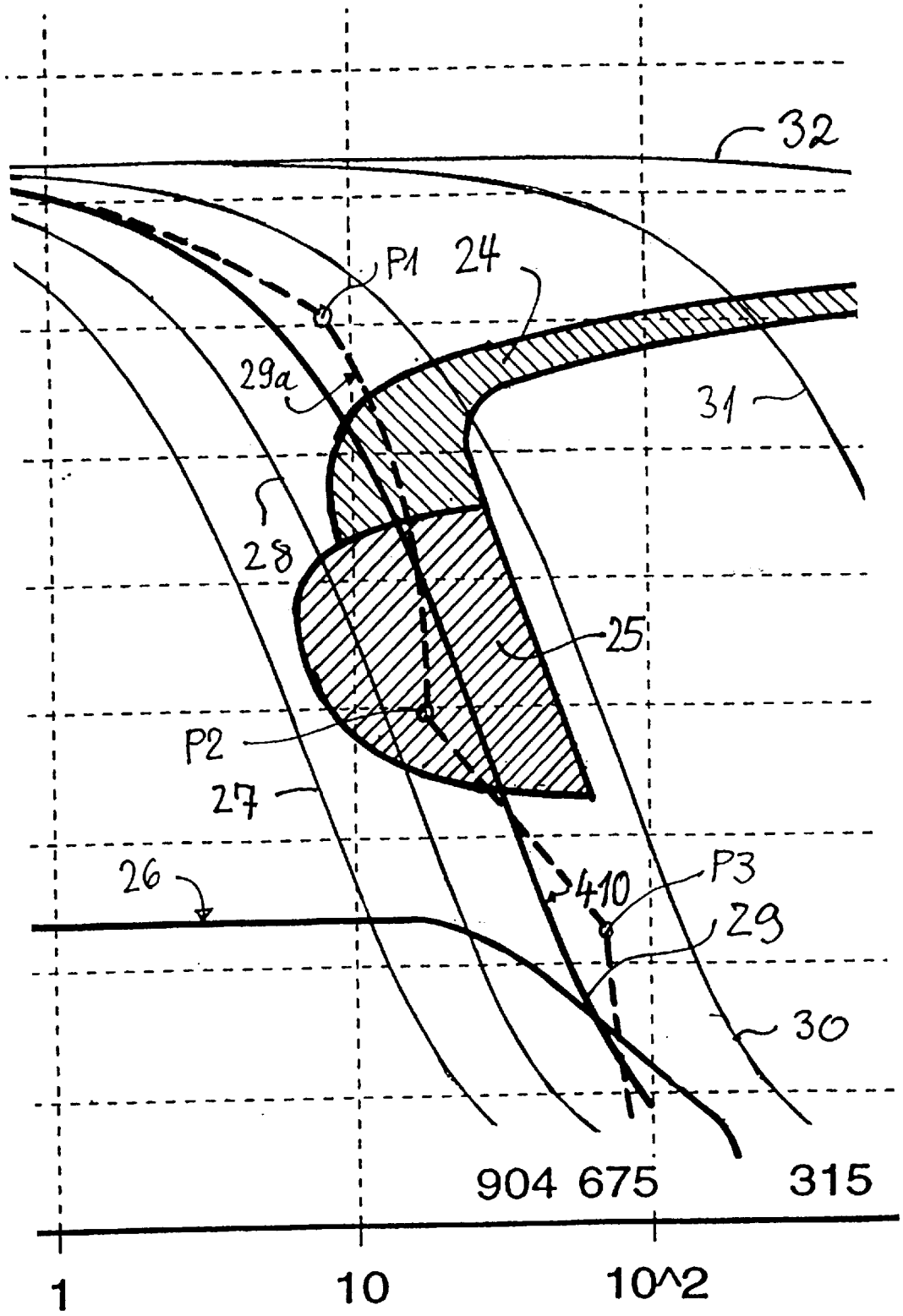

An embodiment of the subject of the invention and its operation are explained below with the aid of FIGS. 1 to 3, wherein:

FIG. 1 is a section through a sensor unit with a measuring body in connection with a block diagram for the signal generation and processing, FIG. 2 is a Z-T-U [time, temperature, conversion] diagram of 100Cr6 steel including curves for the cooling of the measuring body at differing quenching rates, and FIG. 3 an enlargement of a detail of FIG. 2 with a control curve added.

In FIG. 1 there is shown a chamber 1 with a flange 2 and an insulated lead-through 3 for the mounting of a sensor unit 4 which consists of a measuring body 5 with bores and temperature sensors 6 and 7. The measuring body 5 consists preferably of an austenitic alloy with a low emission coefficient in order to reduce heat losses during heating, and it is to match as closely as possible the geometry, mass and thermal conductivity of the workpieces whose thermal analysis is to be made. This is not essential, since conversion factors can be learned based on experience. In the simplest case a cylindrical measuring body with a diameter between 5 and 50 mm, preferably between 15 and 30 mm, will suffice.

The measuring body 5 is held fixed in position by a support 8 and is concentrically surrounded by a heating device 9 in the form of a water-cooled induction coil in which the coolant flow is indicated by the arrows 10 and 11. The induction coil is supplied with heating energy by a medium-frequency generator 12, so that it is possible to perform the heating very quickly and thoroughly, and to start the heating process through a control line 13 and interrupt it abruptly. The induction coil concentrates its heating power exclusively on the measuring body and does not heat its environment, e.g., the chamber walls.

In the vicinity of the sensor unit another temperature sensor 14 is provided by which the gas temperature can be measured. The measurements obtained by the temperature sensors 6, 7 and 14 are fed through lines not further indexed to a central unit 15, which has, in addition to a plurality of storage areas, a keyboard 16 for entering set values and commands and a display 17 for displaying the measurements or a series of measurements, plus set values if desired. A printer 19 can be connected through a data line 18. A diskette drive 20 through which set values and commands can likewise be entered and measurements stored, completes the central unit 15. The gas flow is indicated by arrows 21.

Operation is as follows: The sensor unit 4 permits the direct measurement of the cooling rate. Just before the transfer of a batch of workpieces from a heating chamber or heating furnace into the actual quenching chamber 1, the measuring body 5 is heated to a given temperature, for example to the austenization temperature and then the heat is turned off. After the batch is transferred to the quenching chamber a predetermined quenching gas pressure is built up therein as quickly as possible and circulated in chamber 1 at an appropriate velocity. The quenching gas thus chills both the batch (not shown) and the measuring body.

The temperature sensors 6 (marginal zone) and 7 (center) situated in the measuring body 5 track the local temperatures in the measuring body and enable the determination of the quench curves as represented in FIG. 2. To document these curves, they are stored in relation to the batch in the central unit 15 and/or printed out by the printer 19. To reduce the amount of data, a characteristic cooling parameter can also be stored, such as a lambda value for the cooling period between 800 and 500° C. In this manner a continuous process control can be maintained, by means of which any deterioration of the quenching properties can be detected early, such those that might be caused by the formation of a coating in the heat exchanger.

If, in addition to the temperatures, the gas temperature is also measured by the temperature sensor 14, it is possible by the use of an appropriate evaluation program to determine the thermal transfer coefficient "on-line." In the case of workpieces with a complex geometry, for example, this has the advantage that, by means of this thermal transfer coefficient and an appropriate finite element program differing from the geometry of the measuring body, the quench curve of such complex components can be simulated.

Furthermore, the actual quench curves measured by the sensor unit 4 a comparison can be made by means of the set quench curves stored in the central unit 15.[1/] In the event of differences between the actual curves and the set curves, the quenching rates can be adapted and controlled accordingly, for example by regulating the gas pressure and the gas velocities, so that in this manner any distortion of the workpieces can be minimized thereby.

[1/] This sentence is confused in the German and translated literally, but it probably means: "Furthermore, the actual quench curves measured by the sensor unit 4 can be compared with the set quench curves stored in the central unit 15."

The background of the measurements and controls will now be explained with the aid of FIGS. 2 and 3:

A graph as in FIG. 2 with the abscissae in a logarithmic scale has long been the practice in metallurgy. From the starting point at 0.1 sec to the first abscissa mark is 10 seconds, to the second abscissa mark is 100 seconds, i.e., almost 2 minutes, and to the third abscissa mark 1000 seconds, i.e., almost 17 minutes, etc.

FIG. 2 shows a so-called Z-T-U (time-temperature-conversion) diagram in which the time is recorded in seconds on the abscissae in a logarithmic scale, and the temperature is recorded on the ordinates in a linear scale. For the 100 Cr6 steel, which is difficult to harden, the perlite range 24, the intermediate structure range (bainite range) and the upper boundary of the martensite range 26 are recorded. These areas represent the structure of the material and the material properties for 100 Cr6 (1.2067) steel.

The quench curves 27 to 32 are then recorded for a bar having a 25 mm diameter and the following quench parameters: austenitizing temperature 830° C. and helium as the quenching gas. By varying the quenching rate, for example by changing the pressure, temperature and/or velocity of the quenching gas, the different represented final hardnesses can be achieved at the surface:

| Curve | Vickers Hardness HV |
|---|---|
| 27 | 904 |
| 28 | 675 |
| 29 | 410 |
| 30 | 315 |
| 31 | 268 |
| 32 | 216 |

The heavy curve represents the following quenching conditions: pressure: 20 bar, temperature: 50° C., at an average gas velocity of 20 m/sec.

In the case of a temperature run according to curve 27 ahead of the "noses" of the perlite range 24 and bainite range 25, a martensitic structure is reached. In a temperature run according to curve 28 through the "mose" of the bainite range 25 a structure of the following composition is reached: 40% bainite, 60% martensite. In the case of a temperature run according to the bolded curve 29 through the perlite range 24 and the bainite range 25, a structure of the following composition is reached: 40% perlite, 15% bainite and 45% martensite.

As the curves shift increasingly to the right the final hardness decreases, until at the end only the normal hardness of the material is present.

FIG. 3 shows an enlarged detail from FIG. 2 with the following additions in a greatly simplified and exaggerated form: at point P1 on the actual quench curve 29*a* (broken), the sensor unit of the invention shows, by comparison with a stored set curve, which is curve 29, that the quenching rate is too slow. By varying one of the above factors, e.g., by increasing the gas velocity and pressure, and/or by lowering the gas temperature, the quenching rate is increased and curve 29*a* intersects curve 29.

At point P2 the adjustment is repeated with the opposite sign: the quenching rate is further reduced and curve 29*a* intersects curve 29. With another adjustment of one of the above factors, e.g., by increasing the gas velocity and pressure and/or by lowering the gas temperature, the quenching rate at point P3 is increased again, and curve 29*a* again intersects curve 29, as represented. Actually, curve 29*a* oscillates much more rapidly and with closer intervals around curve 29.

The diagram in any case underlines the advantageous influence on the difficult-to-manage quenching parameters and the advantageous effect of the subject of the invention on the conduct of the process. Similar diagrams apply to all conceivable workpiece shapes and sizes and for all alloys that might be involved, whose Z-T-U diagrams are likewise known.

A sensor system of this kind has to operate satisfactorily with any shape and arrangement of a batch, since this must be left to the user. If this requirement is not taken into account the user would produce rejects.

Above 4 MPa an even greater quenching action might be achieved, but then other problems arise: the faster the quench is performed when hardening, the steeper will be the temperature gradient from the core to the surface of every workpiece, leading to great internal tensions and tension cracking and distortion. Here the rule is, for a compromise: quench as fast as necessary, but not as slowly as possible, in order to achieve the desired hardness and structure.

The measurement and the regulation of such procedures can easily be accomplished by the subject of the invention.

The effect is multiplied by the same advantage at the second heat exchange surface, namely at the built-in cooler and by the high rate of circulation of the cooling gas ("shuttle effect").

What is claimed is:

1. A method for determining the cooling action of a flowing gas atmosphere on workpieces heated in a heating chamber to a predetermined temperature comprising:

a) heating a measuring body positioned in a quenching chamber and comprising a temperature sensor to a given starting temperature corresponding to the same temperature as that of the workpieces, wherein b) the measuring body is exposed to the gas atmosphere circulating through the workpieces in the quenching chamber, wherein c) said measuring body is disposed stationary outside of the workpieces and is heated by a heating device associated with it to said given starting temperature and is then exposed together with the workpieces to the flowing gas atmosphere; and d) measuring the cooling time curves measured by the measuring body, whereby the quenching gas chills both the batch and the measuring body.

2. The method according to claim 1, wherein the cooling processes in time are compared with set values and that the differences between the actual values and the set values are used for the control of at least one factor from the group, gas pressure, gas velocity and cooling performance of a heat exchanger.

3. The method according to claim 1, wherein, in the case of a preheating of the workpieces in a heating chamber before the workpieces are brought into a quenching chamber equipped with the measuring body, the measuring body is heated to the prescribed starting temperature, and that after the workpieces are brought into the quenching chamber the healing of the measuring body is interrupted and the measuring body is exposed to the gas atmosphere circulated in the quenching chamber.

4. The method according to claim 1, wherein the temperature of the gas atmosphere is measured by means of an additional temperature sensor independent of the measuring body and from this the heat transfer coefficient is determined with allowance for the values measured by the temperature sensors.

5. The method according to claim 1, wherein the heating of the measuring body is performed by an induction coil as heating device surrounding the measuring body.

6. The method according to claim 1, wherein the heating of the measuring body is performed by a heating device disposed in the measuring body.

7. The method according to claim 1, wherein the measuring body is heated by passing an electric current through it.

8. The method according to claim 1, wherein the temperature curve is determined by a temperature sensor disposed in the surface area of the measuring body.

9. The method according to claim 1, wherein the temperature curve is determined by a temperature sensor disposed in the center of the measuring body.

10. An apparatus for determining the cooling action of a flowing gas atmosphere on workpieces, which have been heated in a heating chamber, comprising a measuring body, which is heated to workpiece temperature and provided with at least one temperature sensor, and which is disposed in a quenching chamber, wherein the measuring body, fixedly disposed outside of the workpieces, is directly associated with a heating device of its own connectable to a power source, by means of which the measuring body can be heated to a presettable starting temperature, and wherein the measuring body is disposed in the flow path of the gas flow which can be guided over the workpieces.

11. The apparatus according to claim 10, wherein the heating device, associated with the measuring body, is an induction coil surrounding the measuring body.

12. The apparatus according to claim 10, wherein the measuring device, associated with the measuring body, is a heating device disposed in the measuring body.

13. The apparatus according to claim 10, wherein the measuring body is connected into the circuit of a low-voltage power source.

14. The apparatus according to claim 10, wherein, for the determination of the temperature of the gas atmosphere, an additional temperature sensor, independent of the measuring body, is provided, by which the heat transfer coefficient can be determined allowing for the measurements of the temperature sensors of the measuring body.

15. The apparatus according to claim 10, wherein the temperature sensors of the measuring body are wired with storage areas in which the time curves of the measurements of the temperature sensors are comparable with given and stored set curves.

16. The apparatus according to claim 10, wherein the central unit is connected by a control line to a medium-frequency generator, supplying an induction coil, and wherein, after the starting temperature of the measuring body, preset in the central unit, is reached, the induction coil is shut off by the central unit.

17. The apparatus according to claim 10, wherein the measuring body is constructed as a cylinder.

18. The apparatus according to claim 10, wherein the measuring body is formed from an austenitic alloy with a low emission coefficient.

* * * * *

UNITED STATES PATENT AND TRADEMARK OFFICE

CERTIFICATE OF CORRECTION

PATENT NO. : 6,554,922 B2
DATED : April 29, 2003
INVENTOR(S) : Klaus Loeser

It is certified that error appears in the above-identified patent and that said Letters Patent is hereby corrected as shown below:

Title page,
Item [75], Inventor, change "Kalus" to -- Klaus --
Item [73], Assignee, change "Ald" to -- ALD --.

Signed and Sealed this

Ninth Day of September, 2003

JAMES E. ROGAN
*Director of the United States Patent and Trademark Office*